United States Patent [19]

Koester et al.

[11] 4,080,088

[45] Mar. 21, 1978

[54] JOINT EDGE BODY FOR EXPANSION JOINTS IN ROADS

[75] Inventors: Waldemar Koester, Forsbach; Reinhold Huber, Rorbas, both of Switzerland

[73] Assignee: Kober AG, Glarus, Switzerland

[21] Appl. No.: 689,404

[22] Filed: May 24, 1976

[30] Foreign Application Priority Data

Feb. 27, 1976 Germany ..... 2607948

[51] Int. Cl.[2] ..... E01C 11/02

[52] U.S. Cl. ..... 404/74; 29/415; 72/203; 113/116 BB; 404/47

[58] Field of Search ..... 404/68, 69, 47, 74, 404/50, 72; 52/396; 29/400, 415; 72/362, 203, 254; 113/116 BB

[56] References Cited

U.S. PATENT DOCUMENTS

| | | | |
|---|---|---|---|
| 1,098,792 | 6/1914 | Ficklen | 404/69 |
| 1,634,263 | 7/1927 | McInerney | 404/68 |
| 2,405,844 | 8/1946 | Mortenson | 404/69 |
| 3,570,378 | 3/1971 | Honegger | 404/69 |
| 3,626,822 | 12/1971 | Koster | 404/69 |
| 3,877,029 | 4/1975 | Honegger | 404/69 |
| 3,888,599 | 6/1975 | Reifsnyder | 404/69 |

*Primary Examiner*—Nile C. Byers
*Attorney, Agent, or Firm*—William Anthony Drucker

[57] ABSTRACT

The disclosure relates to a joint-edge element for expansion joints in roadways wherein the anchoring parts, that extend in the longitudinal direction of the joint, just as the remaining parts of the joint-edge profiled element, are joined in one piece to the joint-edge element. At least one profiled part of the joint-edge element is produced by dividing the double profiled element in two profiled halves. Joint-edge elements having the double length of the particular extrusion casting or rolled element are produced through a single operation of extrusion or rolling.

A particularly expedient embodiment is produced in such a manner that the anchoring parts are formed by parting a connecting portion of the double profiled element. The parting operation can be performed without considering the precision of manufacture, with relatively low expenditure.

A secure holding and a perfect embedding in the concrete under-structure can be obtained in such a manner that the anchoring parts are produced through the parting operation effected along a line extending in the longitudinal direction of the joint and effecting a serration-type reciprocal meshing of the two halves of the connecting part. The line can here be undulated, dented or provided with another regular or irregular curvature. The serration type gaps permit one to obtain a perfect concrete work, since no cavities have to be filled.

8 Claims, 7 Drawing Figures

6
6
6
15
12
11
10
1
A/2
7
2
4
6
13
14
8
9

JOINT EDGE BODY FOR EXPANSION JOINTS IN ROADS

The invention relates to a joint-edge element for expansion joints in roadways, whose cross section comprises at least one jaw profile for connecting an expansion element that seals the joint gap and possibly a contact strip that rests on the concrete understructure and which element is fastened in the concrete understructure by means of anchoring parts. Further, the invention relates to a process of manufacturing such joint-edge elements.

Joint elements are known in a number of embodiments as connecting elements between the structure and the actual roadway passage. On the one hand, they define the structure-side joint edge; on the other hand, they define the cover of the joint, for which purpose they are employed as bearing surfaces in the case of high-load roadway passage structures or for fastening the elastomer sealing elements that seal the joint, in the case of small loads. A particularly important task of the joint-edge element consists in reinforcing the highly stressed edge of a joint, which problem cannot be solved satisfactorily merely with concrete building material.

In order to solve these problems, the known joint-edge elements, in addition to being provided with their connecting part for covering the joint, are generally equipped with profiled parts that are employed for protecting the concrete edge as well as with anchoring parts for anchoring the joint-edge element in the concrete under-structure.

It is known to manufacture a joint-edge element in its entirely as an extrudable profiled element (German printed specification 2 238 962). This arrangement is provided with anchoring parts in the form of cavities that extend in the longitudinal direction of the joint and are filled with concrete during the assembly or embedding. This results frequently in an incomplete filling of the cavities, i.e. a weakening of the anchoring and preferential spots for the corrosive effect.

Further, there is known an edge element cast in short pieces and comprising anchoring disks extending transversely to the longitudinal direction of the joint (German utility model 7 418 191). Cast structures of this kind are limited in regard to their loading capacity and, besides, require high manufacturing expenses.

In practice, one employs predominently joint-edge elements produced by rolling, their anchoring parts being in the form of anchoring disks, flat-bar steel elements or curved anchors, that extend in each case transversely to the longitudinal direction of the joints and are welded spaced on the joint-edge element extending in the longitudinal direction of the joint (German printed specification 1 964 483; W. Koster, Der Bauingenieur 49 (1974), pages 69 to 73). These embodiments of joint-edge elements are associated with the disadvantage of requiring expensive welding operations.

The invention herein is based on the task of manufacturing joint-edge elements in a particularly economical manner, in which connection economy is to be attained especially on the side of the anchoring parts without a detrimental effect to their strength.

According to the proposal of the invention, the problem is solved on a joint-edge element of the type mentioned at the outset in such a manner that it consists of one half of an extruded or rolled double profiled element which also contains the anchoring parts.

According to this proposal, which foresees an economic manufacture through extrusion or rolling, the anchoring parts, that extend in the longitudinal direction of the joint, just as the remaining parts of the joint-edge profiled element, are joined in one piece to the joint-edge element. At least one profiled part of the joint-edge element is produced by dividing the double profiled element in two profiled halves. Joint-edge elements having the double length of the particular extrusion casting or rolled element are produced through a single operation of extrusion or rolling.

A particularly expedient embodiment is produced in such a manner that the anchoring parts are formed by parting a connecting portion of the double profiled element. The parting operation can be performed without considering the precision of manufacture, with relatively low expenditure.

A secure holding and a perfect embedding in the concrete under-structure can be obtained in such a manner that the anchoring parts are produced through the parting operation effected along a line extending in the longitudinal direction of the joint and effecting a serration-type reciprocal meaning of the two halves of the connecting part. The line can here be undulated, dented or provided with another regular or irregular curvature. The serration-type gaps permit one to obtain a perfect concrete work, since no cavities have to be filled.

In particular when the extrusion art is used, it is not difficult to still equip the half of the double profiled element, which forms the joint-edge element, with a form strip that contacts the concrete under-structure in the interior of the joint gap. A particularly advantageous embodiment is obtained in such a manner that the connecting part forms the contact strip, with the portion adjacent to the jaw profile, and the anchoring part which follows the contact strip, with a portion that is bent in relation to the contact strip after the parting.

A particularly strong anchoring effect is characteristic for a further embodiment wherein the connecting part consists of two parallel plates attached at reciprocal distance on the particular contact strip, the plates forming a double anchoring arrangement after their parting.

Of course, within the scope of the invention it is possible to make the two halves of the double element different. For example, one half is made for the connection to a road-surface lining and the other half is made to be embedded in a concrete roadway. Besides, longitudinally extending ribs may be provided on the profiled parts of such halves, which ribs still improve the connection to the concrete under-structure.

A suitable process of manufacturing the above-mentioned joint-edge elements consists first of all in extruding or rolling a multiple profiled element containing at least two joint-edge elements, which multiple profiled element is then divided through flame cutting, punching, sawing or the like into separate profiled elements, whereafter one or several of the profiled portions of the separate profiled elements can be bent in relation to the jaw profile in a direction adapted to its embedded position.

Several exemplified embodiments of the invention are explained in the following text in reference to the drawings.

Figure 1:
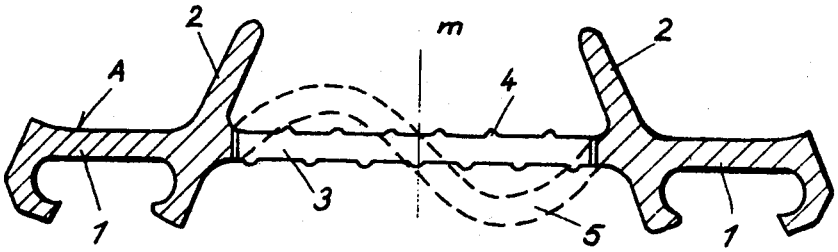
FIG. 1 shows a double profiled element in cross section.

A double profiled element A shown in the cross section of FIG. 1 is symmetrical in relation to a central plane *m*. Each profiled half comprises a jaw outline 1 for connecting an elastomer expansion element, as well as a contact strip 2 with which the edge element of a joint rests on the upper side of the concrete understructure in the area of the joint edge. Contact strip 2 of the embodiment shown is employed simultaneously as an isolating arm for the connection with the isolating layer on which the road surface is placed. Accordingly, contact strip 2 in the embedded position of each of the two halves of the double profiled element, extends in parallel with the road surface, i.e. approximately horizontally.

Central plane *m* designates simultaneously the position of the average tooth height of a serration of a connecting part 3 of the two halves of the double profiled element, which serration is produced by a parting cut. The double profiled element, preferably consisting of steel, or possibly of another metal such as aluminium which is coated with a coating protecting against the alkaline action of fresh concrete, or even consisting of hard synthetic resin, e.g. a glass-fiber reinforced synthetic resin, is divided into two profiled halves, each forming an edge element of the joint. In the case of metallic double profiled elements, the division is effected through flame cutting or punching; in the case of synthetic-resin double profiled elements it is possible to apply a new-type cutting operation.

In order to simplify the manufacture, the double profiled elements may be produced in unit lengths, e.g. of 2 meters. Double profiled elements of steel may be provided with a hot-galvanization coating subsequent to the parting cut, in order to provide portection against corrosion. For the assembly, a number of double profiled element halves may be firmly joined together face-side through welding, soldering or bonding, by means of elastic sleeves or a cement.

Connecting part 3 on which the parting operation is performed represents the anchoring parts of the two single profiled elements. In order to improve the holding in the concrete understructure, connecting element 3 may possess ribs 4 on its surface; it may also possess in entirety the undulated shape shown by discontinuous lines 5.

Figure 2:
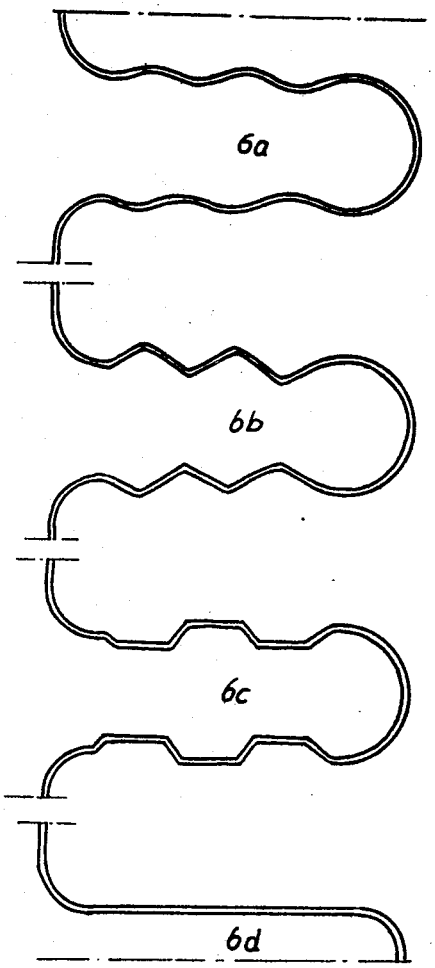
FIG. 2 shows the double profiled elements of FIG. 1 in elevation comprising the separating cut.

FIG. 2 shows an elevation of double profiled element A against the openings of jaw profiles 1, the figures showing only a short portion with a few anchoring teeth 6*a*, 6*b*, 6*c*, 6*d*. The outlines of the anchoring teeth may be undulated (6*a*), dented (6*b*), serrated (6*c*), or smooth (6*d*). FIG. 2 shows the above-mentioned different tooth shapes side by side for the sake of simplicity. Of course, a single suitable tooth shape will be selected in practice.

The serration of the anchoring parts forms the essential feature of their structure. This makes it certain that in the assembled position of each joint-edge element, the gap between the anchoring teeth situated in a plane and the inner side of the joint gap can be perfectly filled up with concrete. The serrated shape of the anchoring parts provides the possibility of a sufficiently firm connection with the concrete under-structure, especially in the area of gaps, in which connection the separate anchoring teeth are arranged, one after another, as seen in the longitudinal direction of the joint. This arrangement is the prerequisite for the application of extrusion or rolling methods in the manufacture of the double profiled element. The application of such methods is of decisive importance for lessening the manufacturing costs of the joint-edge elements that form one half of the double profiled element in each case.

Figures 3, 4:
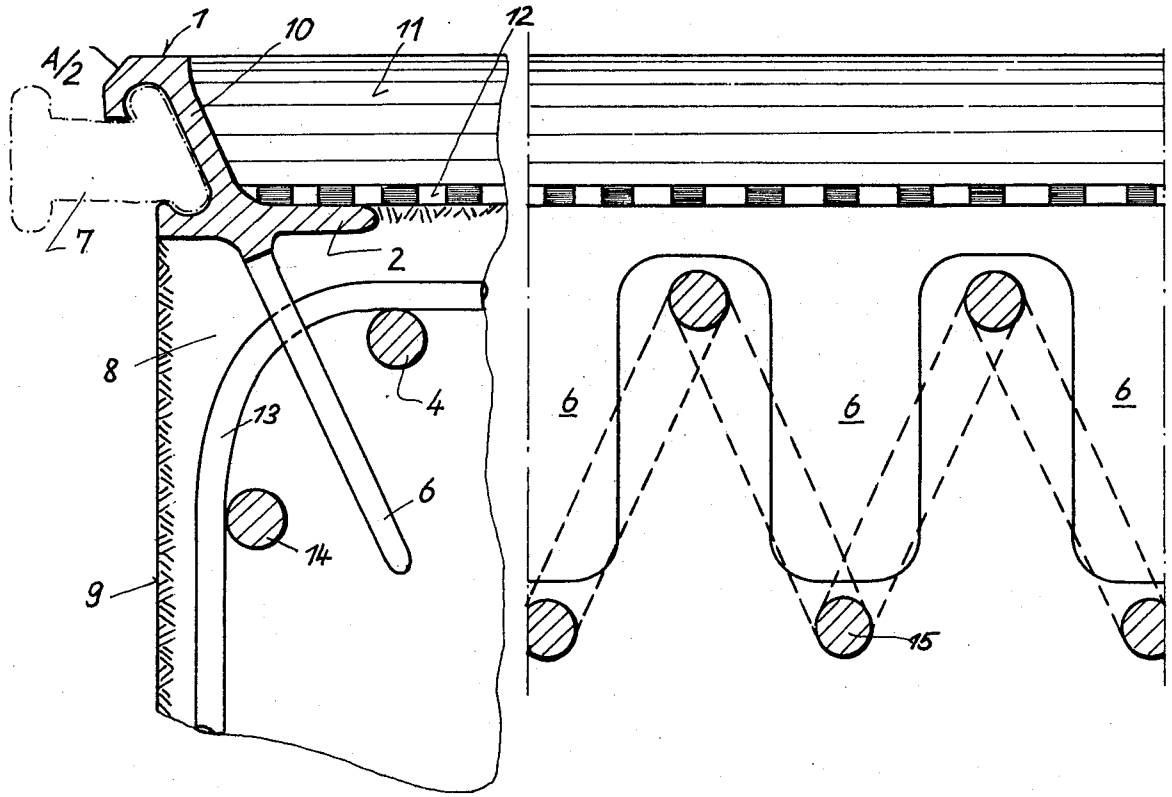
FIG. 3 shows the half double profiled elements of FIG. 1 as embedded element of joint.
FIG. 4 shows a special anchoring of the double profiled element of FIG. 3 in schematic representation.

FIG. 3 shows a cross section through an expansion joint comprising a joint-edge element of FIG. 1 in which connection the left edge of joint and an expansion element 7, which covers the joint, are merely indicated by discontinuous lines. According to FIG. 3, anchoring teeth are arranged in an oblique plane which continues along the back portion of jaw profile 1 of joint-edge element A/2. Accordingly, with increasing depth of their penetration into concrete under-structure 8, anchoring teeth 6 depart to an increasing extent from an inner side 9 of the joint edge. A back portion 10 of jaw profile 1 is followed horizontally by a road surface 11, e.g. of asphalt, which is separated by an isolating layer 12 from the upper side of the concrete understructure 8. With its joint-side edge, isolating layer 12 covers contact strip 2 of joint-edge element A/2, that is employed as an isolating arm.

In order to improve the anchoring effect, further reinforcing parts may be provided in addition to anchoring teeth 6. For example, one effects the connection to the reinforcement of the concrete under-structure by means of reinforcing rods extending in the longitudinal direction of the joint and transversely thereto, in which connection transversely extending reinforcing rods 13 can traverse the gaps between the anchoring teeth, while longitudinally extending reinforcing rods 14 can be arranged on either side of the anchoring teeth.

The reinforcing rods shown in FIG. 3 may also be replaced by a coiled reinforcing rod 15, in accordance with the schematic representation of FIG. 4. The coils of the coiled rod extend like a serration between anchoring teeth 6.

Figure 5:
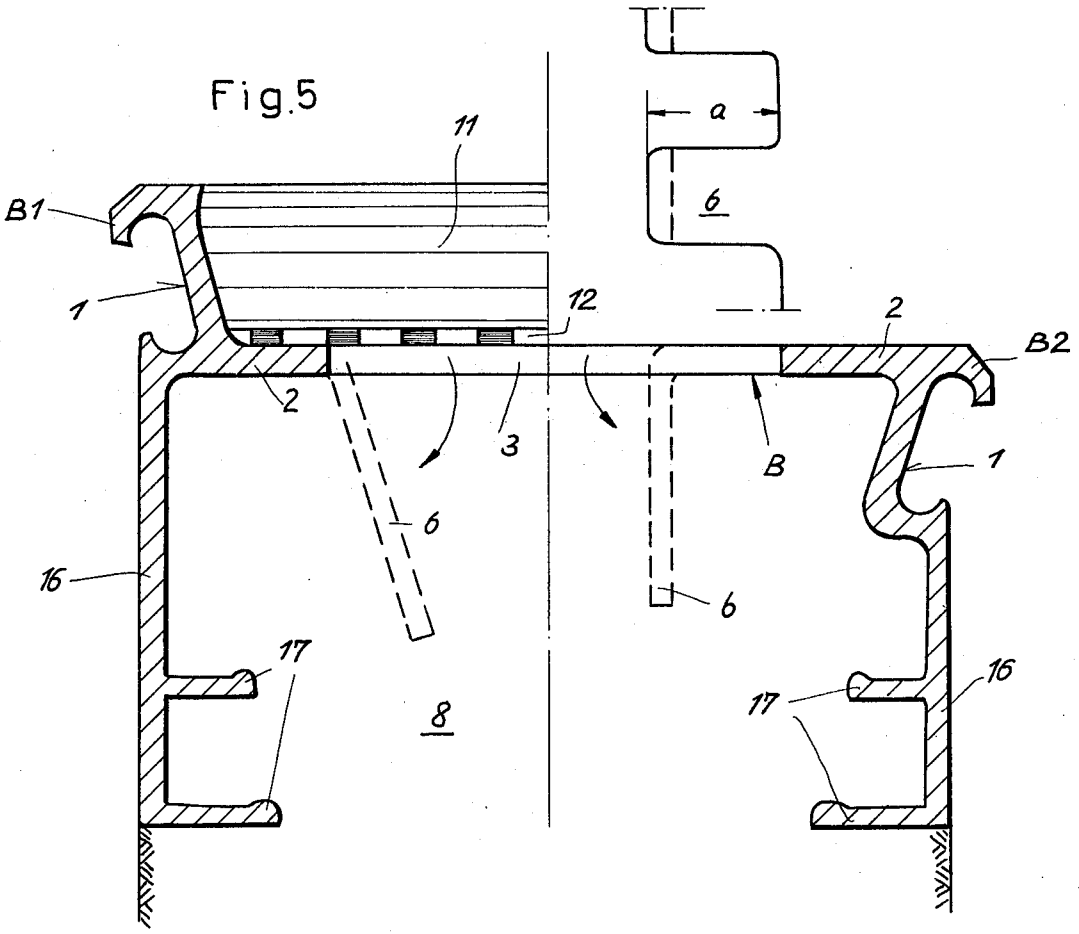
FIG. 5 shows another embodiment of the double profiled element, in cross section.

FIG. 5 shows in cross section a particularly advantageous embodiment of the double profiled element, which consists of different halves in this case. Connecting part 3 of a double profiled element B extends in the direction of contact strip 2 of the two profiled halves on each jaw profile 1. After the serration cut is effected in the area of connection strip 3, anchoring teeth 6 that follow a particular contact strip 2 are bent downward into a position suitable for anchoring. In addition to the portions of profile described in FIGS. 1 to 4, the double profiled element of FIG. 5 still possesses so-called form strips 16, that are attached to jaw profile 1, always approximately at a right angle to contact strips 2. Contact strip 2 and form strip 16 of each joint-edge elements B1 and B2 form jointly an angular cover of the edge of concrete under-structure 8 which is adjacent to the joint.

The left half of profile of FIG. 5 shows a joint-edge element B1, which is suitable for connecting a road-surface lining. The jaw profile is here arranged above the plane of contact strip 2, so as to make possible the connection of road surface lining 11 and isolating layer 12 on the rear side of jaw profile 1. In contrast with this, the right half of profile exhibits a joint-edge element B2, which is suitable for incorporation into a concrete roadway. Contact strip 2 is here attached on the upper side of jaw profile 1 and ends flush with the upper surface of the roadway of the concrete road. The fact that anchoring teeth 6 are bent only at a distance A from contact strip a (see the corresponding representation in sector) produces a serrated transition between contact strip 2 and the concrete roadway which follows it. Such a serrated connection can largely prevent the penetration of concrete to the joint-edge element in the area of transition.

Form strips 16 of joint-edge elements possess ribs 17 on their inner side. The ribs have thickened ends. This arrangement improves the connection to the concrete under-structure. It produces a double anchoring effect, on the one hand, through form strips 16, and, on the other hand, through anchoring teeth 6.

Figure 6:
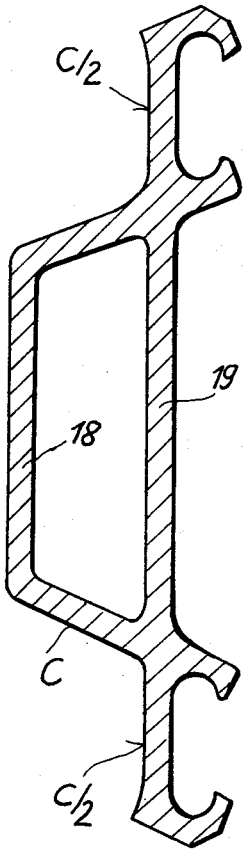
FIG. 6 shows a further embodiment of the double profiled elements in cross section.
Figure 7:
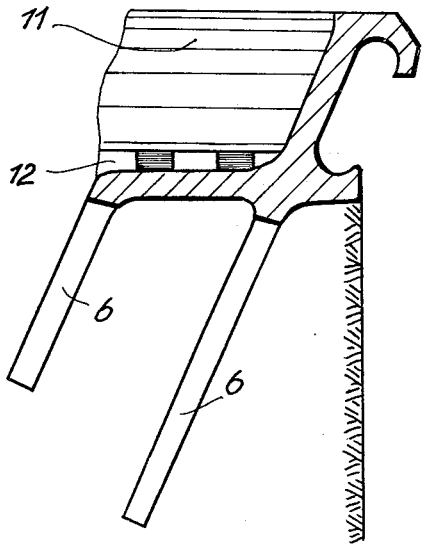
FIG. 7 shows the half double profiled element of FIG. 6 as an embedded edge element of joint.

An improved double anchoring can also be obtained with the structure of a double profiled element C as shown in FIG. 6. Both profiled halves C/2 are here joined to each other by means of an anchoring part consisting of two parallel plates 18, 19, in which connection cuts have to be performed in each of the two plates for the purpose of producing single profiled elements. The partition into profiled halves C/2 produces joint-edge elements of the type shown in FIG. 7 in built-in position as comprising a double anchoring that possesses a wide base. The anchoring parts are in the form of anchoring teeth 6 just as in the other embodiments.

We claim:

1. The method of producing a joint edge body, for expansion joints in road surfaces, in the form of an integral member having a claw profile to receive an expansion body for sealing the joint, a contact strip to rest on a concrete substructure of the road surface, and anchoring elements for securing in said concrete structure, said method including the steps of:

(i) producing selectively by rolling and extruding an elongated member having an transversely spaced positions thereon two assemblies, each including a claw profile and a contact strip, and a common connecting part between said two assemblies, and (ii) dividing said common connecting part along a line which as it proceeds in the direction of elongation of the elongated member passes alternately to one side and the other of a median longitudinal axis of the member, such that the respective portion of the common connecting part which remains integral with each such assembly thereby constitutes said anchoring elements.

2. The method claimed in claim 1 wherein said line of division is selectively undulated, zig-zag, and curved in regular and irregular manner.

3. The method claimed in claim 1 wherein there is produced in step (i) thereof, for each assembly, a depending strip to rest against the concrete substructure in the interior of the expansion joint gap.

4. The method claimed in claim 1 wherein the respective portion of the common connecting part which remains integral with each such assembly further forms, (a) with a continuation of said claw profile, and contact strip, and (b) with a continuation of said contact strip, bent in relation thereto after division, said anchoring elements.

5. The method claimed in claim 1 wherein, in step (i), said common connecting part is formed with longitudinal ribs which become incorporated in said anchoring elements.

6. The method claimed in claim 3, wherein, in step (i), said depending strip is formed with longitudinal ribs.

7. The method claimed in claim 1 wherein, in step (i) said common connecting part is formed with undulations which extend transversely to the elongation of the member and which become incorporated in the anchoring elements.

8. The method claimed in claim 1 wherein, in step (i), said common connecting part is formed with two parallel plates attached in spaced relationship to the respective contact strip and which, after the division, provide a dual anchoring system.

* * * * *